US010391788B2

(12) United States Patent
Umeda et al.

(10) Patent No.: US 10,391,788 B2
(45) Date of Patent: Aug. 27, 2019

(54) ELEMENT SUBSTRATE, PRINTHEAD, AND PRINTING APPARATUS

(71) Applicant: CANON KABUSHIKI KAISHA, Tokyo (JP)

(72) Inventors: Kengo Umeda, Tokyo (JP); Ryo Kasai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/590,489

(22) Filed: May 9, 2017

(65) Prior Publication Data

US 2017/0348979 A1 Dec. 7, 2017

(30) Foreign Application Priority Data

Jun. 1, 2016 (JP) ..... 2016-110214

(51) Int. Cl.
*B41J 2/045* (2006.01)
*B41J 2/335* (2006.01)
(Continued)

(52) U.S. Cl.
CPC ..... *B41J 2/33535* (2013.01); *B41J 2/04535* (2013.01); *B41J 2/06* (2013.01);
(Continued)

(58) Field of Classification Search
CPC .. B41J 2/0458; B41J 2/04541; B41J 2/04573; B41J 2/04543; B41J 2/355; B41J 2/0455;
(Continued)

(56) References Cited

U.S. PATENT DOCUMENTS 5,173,717 A * 12/1992 Kishida ..... B41J 2/04541 347/13
6,439,680 B1 8/2002 Mochizuki et al.
(Continued)

FOREIGN PATENT DOCUMENTS

CN 1277111 A 12/2000
CN 104417051 A 3/2015
(Continued)

OTHER PUBLICATIONS

Office Action dated Dec. 27, 2018, in counterpart application CN 201710403994.5 (15 pages).

*Primary Examiner* — Yaovi M Ameh
(74) *Attorney, Agent, or Firm* — Venable LLP

(57) ABSTRACT

An element substrate, comprises: a plurality of printing elements configured to discharge liquid; a plurality of first driving elements disposed in correspondence with the plurality of printing elements and configured to drive the plurality of printing elements; a plurality of heating elements configured to heat the element substrate; a plurality of second driving elements disposed in correspondence with the plurality of heating elements and configured to drive the plurality of heating elements; and a delay unit that delays timing of driving the plurality of second driving elements to drive the plurality of second driving elements at a predetermined time difference when driving the plurality of second driving elements simultaneously.

10 Claims, 14 Drawing Sheets

(51) Int. Cl.

| | |
|---|---|
| ***B41J 2/06*** | (2006.01) |
| ***B41J 29/38*** | (2006.01) |
| *B41J 2/01* | (2006.01) |
| *B41J 29/00* | (2006.01) |
| *B41J 2/04* | (2006.01) |

(52) U.S. Cl.
CPC ..... *B41J 29/38* (2013.01); *B41J 2/01* (2013.01); *B41J 2/04503* (2013.01); *B41J 2/04511* (2013.01); *B41J 2/04541* (2013.01); *B41J 29/00* (2013.01); *B41J 2002/041* (2013.01)

(58) Field of Classification Search
CPC ..... B41J 29/38; B41J 2/335; B41J 2/04511; B41J 2/33535; B41J 2/04535; B41J 2/06; B41J 2/04503; B41J 2002/041; B41J 2/01; B41J 29/00
USPC ... 347/5, 9, 10, 12, 14, 20, 56, 57, 171, 180
See application file for complete search history.

(56) References Cited

U.S. PATENT DOCUMENTS

| | | | | |
|---|---|---|---|---|
| 6,742,874 | B2 | 6/2004 | Hirayama et al. | |
| 7,055,923 | B2 | 6/2006 | Mochizuki et al. | |
| 7,108,345 | B2 | 9/2006 | Mochizuki et al. | |
| 9,039,126 | B2 | 5/2015 | Hirayama et al. | |
| 9,272,508 | B2 | 3/2016 | Umeda et al. | |
| 2002/0171696 | A1 | 11/2002 | Mochizuki et al. | |
| 2002/0191052 | A1 | 12/2002 | Hirayama et al. | |
| 2005/0057589 | A1 | 3/2005 | Mochizuki et al. | |
| 2007/0296745 | A1* | 12/2007 | Kasai | B41J 2/04541 347/9 |
| 2014/0300660 | A1 | 10/2014 | Hirayama et al. | |
| 2015/0062212 | A1* | 3/2015 | Umeda | B41J 2/04541 347/9 |
| 2016/0121604 | A1 | 5/2016 | Umeda et al. | |

FOREIGN PATENT DOCUMENTS

| | | | |
|---|---|---|---|
| JP | 2012-206280 | A | 10/2012 |
| JP | 2014-200972 | A | 10/2014 |
| KR | 10-2002-0096899 | A | 12/2002 |

* cited by examiner

WHEN SUB HEATER DRIVING DELAY MEANS IS DISPOSED

MALFUNCTION (OVERCURRENT) OF DRIVING ELEMENT FOR SUB HEATER

MALFUNCTION (OVERCURRENT) OF DRIVING ELEMENT FOR PRINTING ELEMENT

ELEMENT SUBSTRATE, PRINTHEAD, AND PRINTING APPARATUS

BACKGROUND OF THE INVENTION

Field of the Invention

The present invention relates to an element substrate, a printhead, and a printing apparatus.

Description of the Related Art

Conventionally, it has been necessary to apply a stable voltage to a heater in order to achieve stable discharge characteristics in an inkjet printhead that discharges ink from a plurality of discharge ports using thermal energy. In an element substrate for a printhead, a plurality of heaters, and a plurality of driving elements in correspondence with the plurality of heaters are arranged. A driving element is configured by a field-effect transistor, and drives a heater by switching. When a plurality of such heaters are simultaneously driven, a large current flows to a ground wiring and a drive power supply wiring supplying power to the heaters. The occurrence of electromagnetic noise due to inductive coupling between the ground wiring and the drive power supply wiring on the rising edge and the falling edge of the supply of such a large current becomes a problem.

A logic circuit, other than a heater, that receives and processes high-speed print data is disposed in the element substrate of a printhead. For this reason, there is the possibility that a logic circuit malfunction will occur when electromagnetic noise due to the foregoing inductive coupling occurs in a ground wiring. Accordingly, a configuration in which, in the element substrate and the printhead, a heater ground wiring and a ground wiring for a logic circuit and the element substrate are separated is taken. By this, electromagnetic noise that occurs when a plurality of heaters are driven being transmitted to the ground wiring for the logic circuit and the element substrate is prevented, and the logic circuit malfunctioning is prevented.

In an element substrate for a printhead, substrate temperature control is being carried out in accordance with recent demand for improvements in image quality. In an element substrate for a printhead, there is variation in discharge speed and the amount of a droplet of ink discharged in accordance with the temperature. For this reason, if there is a temperature distribution depending on the position of the substrate temperature, the temperature distribution will result in image unevenness, and the image quality will decrease. As a method of correcting image temperature distribution, in Japanese Patent Laid-Open No. 2014-200972, for example, high image quality is realized by suppressing temperature unevenness in a substrate by a plurality of sub-heaters being disposed in an element substrate, and heating specific areas. Furthermore, because it is possible to heat a plurality of areas without increasing the number of terminals by mounting sub-heater driving elements in the element substrate, printing apparatus main body cost reduction can be realized.

When the plurality of sub-heaters are simultaneously driven, a large current on the order of A (amperes) flows. The length of wiring of the drive power supply wiring to the element substrate from a power circuit arranged on printing apparatus main body and the length of the wiring of a ground wiring become longer, and a parasitic inductance component becomes larger. Ringing occurs when a large current flows at a time of sub-heater driving to this parasitic inductance component. A potential difference between the ground wiring for a sub-heater and the ground wiring for an element substrate temporarily occurs due to such ringing. A field-effect transistor which is a driving element turns on by this potential difference, and as a result, a large current on the order of A (amperes) flows in the parasitic transistor, causing a malfunction of the driving element.

SUMMARY OF THE INVENTION

The present invention realizes higher reliability by achieving prevention of malfunctions of both a logic circuit and a driving element in an element substrate in which a sub-heater is mounted and substrate temperature control is performed.

According to one aspect of the present invention, there is provided an element substrate, comprising: a plurality of printing elements configured to discharge liquid; a plurality of first driving elements disposed in correspondence with the plurality of printing elements and configured to drive the plurality of printing elements; a plurality of heating elements configured to heat the element substrate; a plurality of second driving elements disposed in correspondence with the plurality of heating elements and configured to drive the plurality of heating elements; and a delay unit configured to delay timing of driving the plurality of second driving elements to drive the plurality of second driving elements at a predetermined time difference when driving the plurality of second driving elements simultaneously.

According to another aspect of the present invention, there is provided a printhead, comprising: a plurality of printing elements configured to discharge liquid; a plurality of first driving elements disposed in correspondence with the plurality of printing elements and configured to drive the plurality of printing elements; a plurality of heating elements configured to heat an element substrate; a plurality of second driving elements disposed in correspondence with the plurality of heating elements and configured to drive the plurality of heating elements; and a delay unit configured to delay timing of driving the plurality of second driving elements to drive the plurality of second driving elements at a predetermined time difference when driving the plurality of second driving elements simultaneously.

According to another aspect of the present invention, there is provided a printing apparatus, comprising: a plurality of printing elements configured to discharge liquid; a plurality of first driving elements disposed in correspondence with the plurality of printing elements and configured to drive the plurality of printing elements; a plurality of heating elements configured to heat an element substrate; a plurality of second driving elements disposed in correspondence with the plurality of heating elements and configured to drive the plurality of heating elements; and a delay unit configured to delay timing of driving the plurality of second driving elements to drive the plurality of second driving elements at a predetermined time difference when driving the plurality of second driving elements simultaneously.

By the present invention, it becomes possible to prevent malfunctions of a logic circuit and a driving element by suppressing the occurrence of ringing according to rising and falling of current when driving a sub-heater.

Further features of the present invention will become apparent from the following description of exemplary embodiments (with reference to the attached drawings).

DESCRIPTION OF THE EMBODIMENTS

Figure 1:
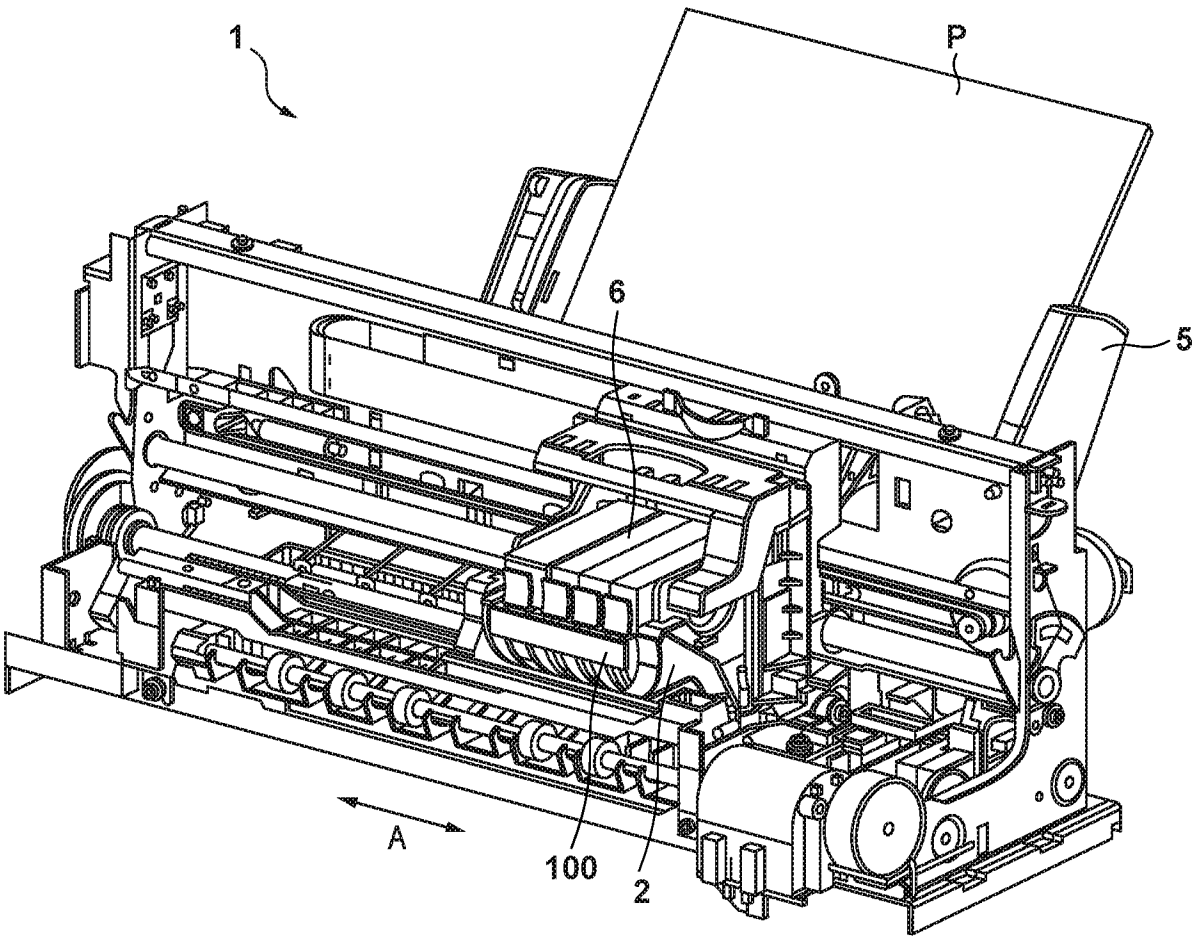
FIG. 1 is an external perspective view illustrating an example of a configuration of an inkjet printing apparatus according to the present application invention.

Below, more specific and detailed description of preferred embodiments of the present invention is given with reference to the attached drawings. However, relative arrangements of configuration elements, and the like that are recited in the present embodiment are not intended to limit the scope of the invention thereto, unless specifically stated.

Note that in this specification, "print" encompasses forming not only meaningful information such as characters and shapes, but also meaningless information. Furthermore, "print" broadly encompasses cases in which an image or pattern is formed on a print medium irrespective of whether or not it is something that a person can visually perceive, and cases in which a medium is processed.

Also, "print medium" broadly encompasses not only paper used in a typical printing apparatus, but also things that can receive ink such as cloths, plastic films, metal plates, glass, ceramics, wood materials, hides or the like.

Furthermore, similarly to the foregoing definition of "print", "ink" (also referred to as "liquid") should be broadly interpreted. Accordingly, "ink" encompasses liquids that by being applied to a print medium can be supplied in the forming of images, patterns or the like, processing of print mediums, or processing of ink (for example, insolubilization or freezing of a colorant in ink applied to a print medium).

Furthermore, "print element", unless specified otherwise, encompasses a discharge port and an element that produces energy that is used for discharge of ink and a fluid channel that communicates therewith collectively.

Furthermore, "nozzle", unless specified otherwise, encompasses a discharge port and an element that produces energy that is used for discharge of ink and a fluid channel that communicates therewith collectively.

An element substrate for a printhead (a head substrate) used below does not indicate a mere substrate consisting of a silicon semiconductor but rather indicates a configuration in which elements, wiring, and the like are disposed.

Furthermore, "on the substrate" means not only simply on top of the element substrate, but also the surface of the element substrate, and the inside of the element substrate in the vicinity of the surface. Also, "built-in" in the present invention does not mean that separate elements are simply arranged as separate bodies on a substrate surface, but rather means that the elements are formed and manufactured integrally on the element board by a semiconductor circuit manufacturing process.

For an inkjet printhead (hereinafter referred to as printhead) having the most important features of the present invention, on an element substrate of a printhead, a plurality of printing elements and a driving circuit that drives these printing elements are implemented on the same substrate. As will be clear from the description below, a plurality of element substrates are integrated in a printhead, and these element substrates have a cascade connection structure. Accordingly, this printhead is able to achieve a print width that is relatively long. Accordingly, the printhead is used not only in a serial type printing apparatus that is commonly found, but also in a printing apparatus comprising a full-line printhead whose print width corresponds to the width of the print medium. Also, the printhead is used in large format printers that use print mediums of a large size such as A0 and B0 in serial type printing apparatuses.

Accordingly, firstly, a printing apparatus in which the printhead of the present invention is used is described.

[Printing Apparatus Overview Description]

FIG. 1 is an external perspective view illustrating an overview of a configuration of a printing apparatus that performs printing using an inkjet printhead (hereinafter referred to as the printhead) which is a representative embodiment of the present invention.

As illustrated in FIG. 1, in the inkjet printing apparatus (hereinafter referred to as the printing apparatus) 1, an inkjet printhead (hereinafter referred to as the printhead) 100, which performs printing by discharging ink in accordance with an ink-jet method, is mounted on a carriage 2, and printing is performed by causing the carriage 2 to move back and forth in the direction of the arrow symbols A. A print medium P such as a printing paper is fed via a sheet supply mechanism 5, and conveyed to a printing position, and the printing is performed by discharging ink to the print medium P from a printhead 100 at that printing position.

Not only is the printhead 100 mounted in the carriage 2 of the printing apparatus 1, an ink tank 6 containing ink to be supplied to the printhead 100 is attached thereto. The ink tank 6 can be attached/detached in relation to the carriage 2.

The printing apparatus 1 illustrated in FIG. 1 can perform color printing, and four ink cartridges that respectively accommodate magenta (M), cyan (C), yellow (Y), and black (K) ink are mounted to the carriage 2 for this. These four ink cartridges can each be independently attached/detached.

The printhead 100 according to the present application invention employs an ink-jet method in which ink is discharged using thermal energy. Accordingly, an electrothermal transducer is comprised. The electrothermal transducer is disposed for each discharge port, and ink is discharged from a corresponding discharge port by applying a pulse voltage to the corresponding electrothermal transducer in accordance with a printing signal. Note that the printing apparatus is not limited to the foregoing serial type printing apparatus, and can be applied to a so-called full-line type printing apparatus in which a printhead (line head) in which discharge ports are arranged in a widthwise direction of the print medium are arranged in a direction of conveyance of the print medium.

Figure 2:
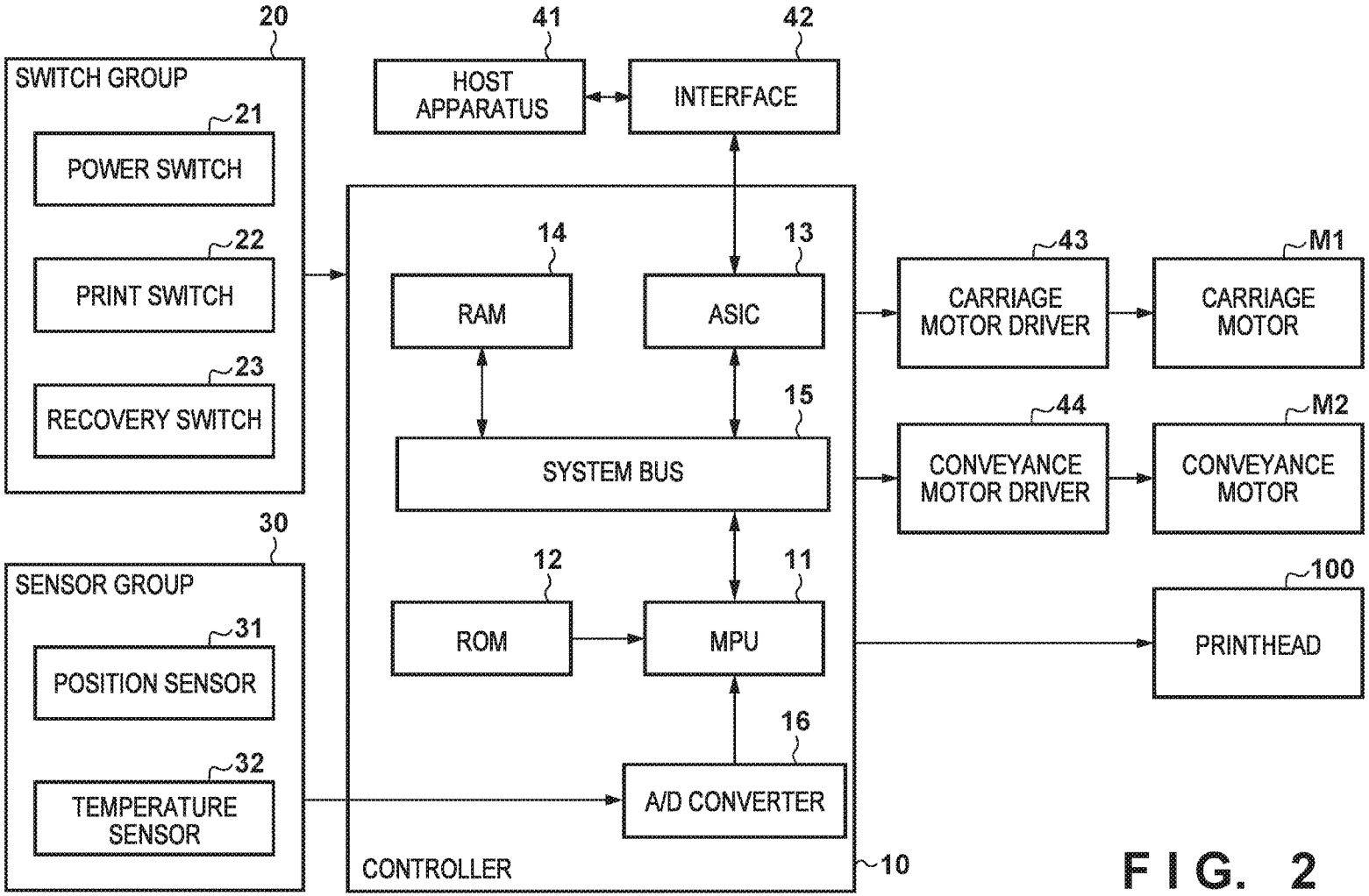
FIG. 2 is a view illustrating an example of a control configuration of the inkjet printing apparatus according to the present application invention.

FIG. 2 is a block diagram illustrating a control configuration of the printing apparatus illustrated in FIG. 1.

As illustrated in FIG. 2, a controller 10 is configured by an MPU 11, a ROM 12, an application-specific integrated circuit (ASIC) 13, a RAM 14, a system bus 15, an A/D converter 16, and the like. The ROM 12 stores programs corresponding to each type of control sequence, required tables, and other fixed data. The ASIC 13 generates control signals for control of a carriage motor M1, control of a conveyance motor M2, and control of the printhead 100. The RAM 14 is used as an image data loading region, a work region for program execution, or the like. The system bus 15 connects the MPU 11, the ASIC 13, and the RAM 14 to each other and performs reception of data. The A/D converter 16 inputs analog signals from a sensor group described below, performs an A/D conversion thereon, and supplies resultant digital signals to the MPU 11.

Also, in FIG. 2, a host apparatus 41 is an external information processing apparatus such as a PC that is an image data supply source.

Transmission/reception of image data, commands, statuses and the like between the host apparatus 41 and the printing apparatus 1 is performed by packet communication via an interface (I/F) 42. Note that configuration may be taken so as to further comprise a USB interface as the interface 42 separately to a network interface, and enable reception of bit data and raster data that is serially transferred from the host.

A switch group 20 is configured from a power supply switch 21, a print switch 22, a recover switch 23, and the like.

A sensor group 30 is a sensor group for detecting an apparatus state, and is configured from a position sensor 31, a temperature sensor 32 and the like. Also, a photosensor that detects a remaining amount of ink is disposed.

A carriage motor driver 43 is a carriage motor driver for driving the carriage motor M1 in order to cause the carriage 2 to reciprocally scan in the direction of arrow symbols A. A conveyance motor driver 44 is a conveyance motor driver that drives the conveyance motor M2 which is for conveying the print medium P.

The ASIC 13 transfers data for driving a heating element (heater for ink discharge) in relation to the printhead while directly accessing a storage region of the RAM 14 upon printing and scanning by the printhead 100. In addition, a display unit configured by an LCD or an LED is configured on the printing apparatus as a user interface.

Next, an embodiment of a head substrate (element substrate) that configures a liquid discharge head used as a printhead in the printing apparatus of the foregoing configuration is described.

<First Embodiment>

Figure 3:
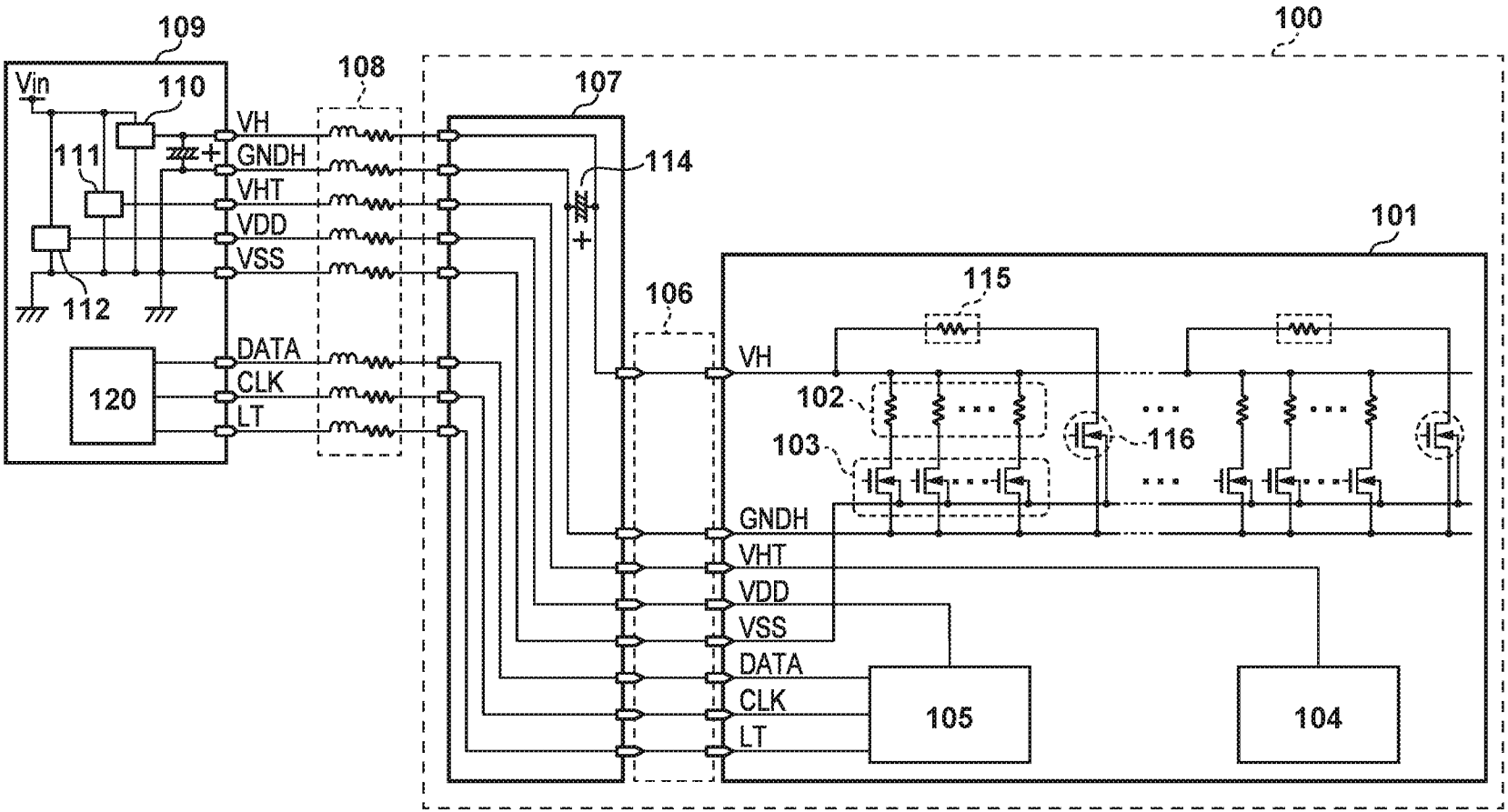
FIG. 3 is a view illustrating an example of a configuration of the printhead according to a first embodiment.

FIG. 3 illustrates an example of a configuration of the printhead 100 in the printing apparatus 1 according to a first embodiment of the present invention. The printhead 100 is configured to include a printing element substrate 101, a flexible substrate 106, and a print circuit board 107. The printing element substrate 101 is electrically connected to the print circuit board 107 via the flexible substrate 106. The print circuit board 107, via cables 108, is electrically connected to a head control substrate 109 which is arranged on the main body of the printing apparatus 1.

The printing element substrate 101 is described in detail. The printing element substrate 101 is configured to include a plurality of a printing element 102, a plurality of a driving element 103, a control gate 104, a logic circuit 105, a sub-heater 115, and a driving element 116. In the present embodiment, the printing element substrate 101 is configured by a semiconductor layer, a wiring layer, and an insulating layer.

The printing element 102 is a printing element group for heating and discharging an ink. The driving element 103 is a group of printing element driving elements that drives the printing element 102. A field-effect transistor (FET: Field Effect Transistor) is mainly used for the driving element 103. The control gate 104 is a control gate group that controls the driving element 103.

The logic circuit 105 is a logic circuit for sending a control signal to the control gate 104. The logic circuit 105 is mainly configured from a latch circuit that holds print data, a shift register circuit, and an HE generation circuit that generates a heat-enable signal (HE) for deciding a time when a driving element is turned on. Detail of these circuits is described later. The logic circuit 105 receives various signals transmitted from a head control IC 120. The various signals here correspond to a data signal (DATA), a clock signal (CLK), and a latch signal (LT). Note that the head control IC 120 is arranged on the head control substrate 109. The sub-heater 115 is a heater (heating element) that heats a specific area of the printing element substrate 101, and that heats the printing element substrate 101 to an extent that the ink is not discharged by the heating. The driving element 116 is a sub-heater driving element for driving the sub-heater 115. In the present embodiment, the driving element 103 for the printing element and the driving element 116 for the sub-heater are assumed to be disposed on the same semiconductor layer. Also, in the present embodiment, the driving elements 103 and 116 are assumed to all use N-type field-effect transistors.

One terminal of the printing element 102 is connected to a printing element power supply (VH) for supplying a drive power supply, and the other terminal is connected to a drain terminal of the FET which is the driving element 103. Similarly, for the sub-heater 115 and the printing element 102, one terminal is connected to the printing element power supply (VH) and the other terminal is connected to the drain terminal of the FET (the driving element 116). Also, the source terminals of the driving element 103 for the printing element and the driving element 116 for the sub-heater are connected to a printing element ground wiring (GNDH), and a substrate terminal (back gate) is connected to a substrate ground wiring (VSS). A power supply of the control gate 104 is connected to a control gate power supply wiring (VHT), and the power supply of the logic circuit 105 is connected to a logic circuit power supply wiring (VDD). Ground terminals of the control gate 104 and the logic circuit 105 are connected to the substrate ground wiring (VSS).

A printing element power supply (VH) for driving the printing element 102 and the sub-heater 115 and the printing element ground (GNDH) are connected to a power circuit 110 on the head control substrate 109. These power supplies are generated in the power circuit 110 and supplied to the printing element substrate 101 via the cable 108, the print circuit board 107, and the flexible substrate 106. The printing element ground wiring (GNDH) and the substrate ground wiring (VSS) are separated in the printhead 100, and are short-circuited on the head control substrate 109. By this, electromagnetic noise that occurs when the plurality of the printing element 102 and the sub-heater 115 are driven being transmitted to the substrate ground wiring (VSS) is prevented, and the logic circuit malfunctioning is prevented.

There are cases when the length of the wiring of the cable 108 is greater than or equal to 1 m due to restrictions in the arrangement in the printing apparatus 1 of the printhead 100 and the head control substrate 109, and the amount of parasitic inductance increases in conjunction with this. Specifically, the order of several hundred nH to 1 μH is reached in the cable 108 alone. To reduce VH-GNDH ringing that occurs due to a large parasitic inductance of the cable 108, a capacitor 114 is disposed on the print circuit board 107 between VH and GNDH. An electrolyte capacitor of several hundred μF, for example, is used for the capacitor 114.

Figure 4:
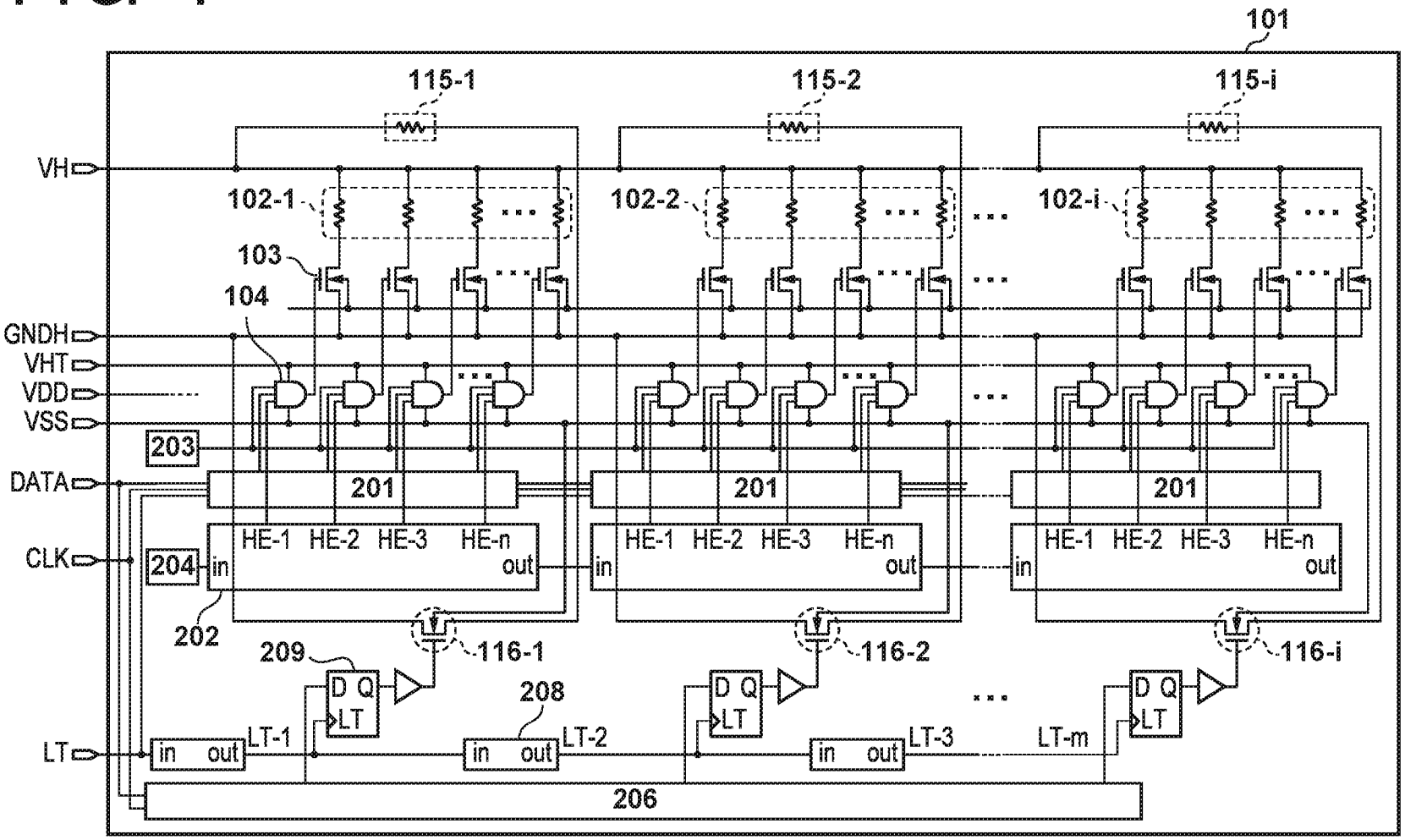
FIG. 4 is a view illustrating an example of a configuration of the printing element substrate according to a first embodiment.

FIG. 4 is a view illustrating an example of a detailed configuration of the printing element substrate 101 according to a first embodiment. Note that in FIG. 4, additional suffixes are added to reference numerals in the case where there is a plurality of the same configuration element. A latch circuit 201 is a print data shift register/latch circuit that holds print data, and the print data is caused to be held using the latch signal (LT). A logic circuit 203 is a block-selection logic circuit that activates the control gate 104 on a block basis time-divisionally. An HE generation circuit 204 is an HE generation circuit that generates a heat-enable signal (HE) for deciding the time when the driving element 103 is turned on. An HE pulse delay circuit 202 is a heat-enable pulse delay circuit for delaying the heat-enable signal (HE) and outputs a delay-heat-enable signal. The control gate 104 controls whether the driving element 103 of the printing element is on or off by a logical product of print data, a block-selection signal, and the heat-enable signal (HE).

A latch circuit 209 is a sub-heat data latch circuit for holding sub-heat data. A shift register circuit 206 is a sub-heat data shift register circuit for transferring sub-heat data. A latch signal delay circuit 208 is a latch signal delay circuit that causes a latch signal to be delayed for several ns to several hundred ns. The latch circuit 209, which is plurally provided, stores sub-heat data based on a delay latch signal (LT-1, LT-2, . . . , LT-m) which is delayed by the latch signal delay circuit 208. Therefore, the timing at which the sub-heat data are stored in each of the plurality of the latch circuit 209 is delayed several ns to several hundred ns. The driving element 116 for the sub-heater is turned on or turned off simultaneously to the sub-heat data being stored in the latch circuit 209. Therefore, the timing at which each of the plurality of the sub-heater 115 are driven is delayed several ns to several hundred ns.

Figure 5A:
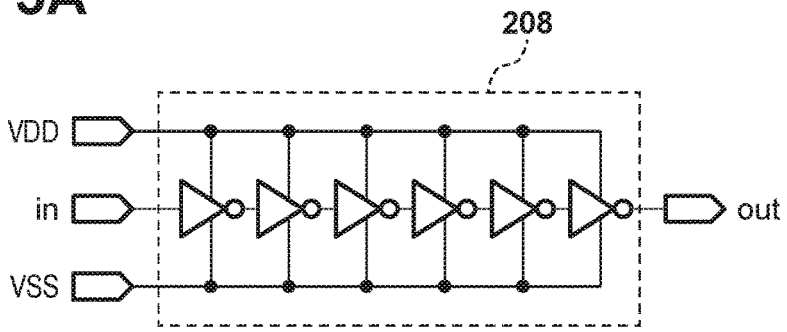
FIGS. 5A and 5B are views illustrating configuration examples of a latch signal delay circuit.
Figure 5B:
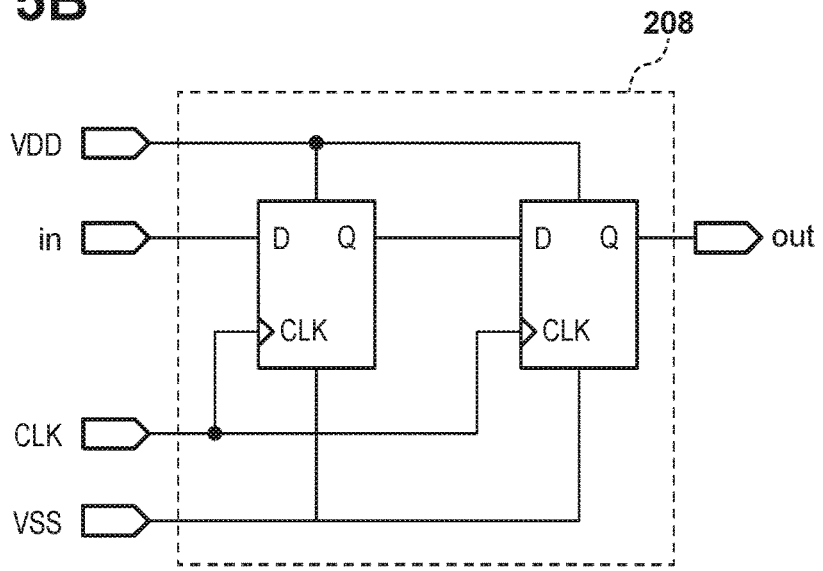

FIG. 5A and FIG. 5B are views illustrating examples of the latch signal delay circuit 208. In FIG. 5A, the latch signal delay circuit 208 is configured by a plurality of inverter circuits, and the delay time of the latch signal delay circuit 208 as a whole is decided by the delay time for an inverter circuit corresponding to one step ×the number of steps of the inverter circuit. FIG. 5B is a view illustrating a separate example of the latch signal delay circuit 208. In FIG. 5B, the latch signal delay circuit 208 is configured by a plurality of flip flop circuits, and the delay time of the latch signal delay circuit 208 as a whole is decided by the clock signal period×the number of steps of the flip flop circuit.

Figure 6:
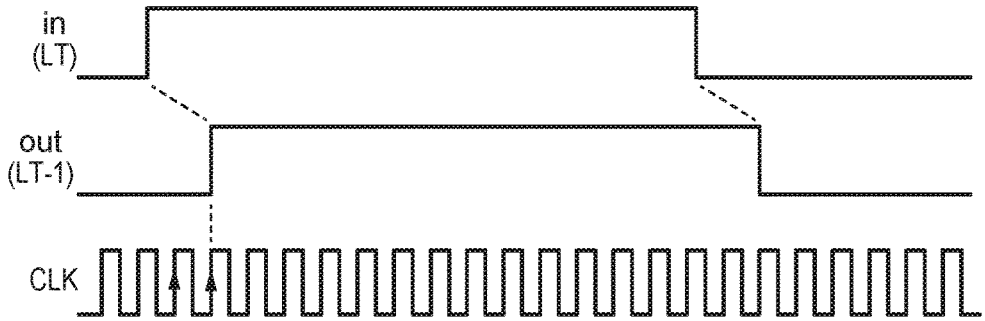
FIG. 6 is a figure illustrating a timing chart for the latch signal delay circuit.

FIG. 6 is a view illustrating a timing chart of the latch signal delay circuit 208 of FIG. 5B. In the present embodiment, the printing element substrate 101 performs time-divisional driving in which one line of printing is divided into a predetermined number of blocks, and the sub-heater 115 is sequentially driven. Here, line time indicates the time for printing one column's worth or one row's worth of an image (line) to a print medium. Block time indicates the time needed to print one block on a block basis, and one line time corresponds to the time (time for a predetermined number of blocks) needed to print the foregoing predetermined number of blocks. Also, a latch signal (LT) is a signal for specifying one block.

Figure 7A:
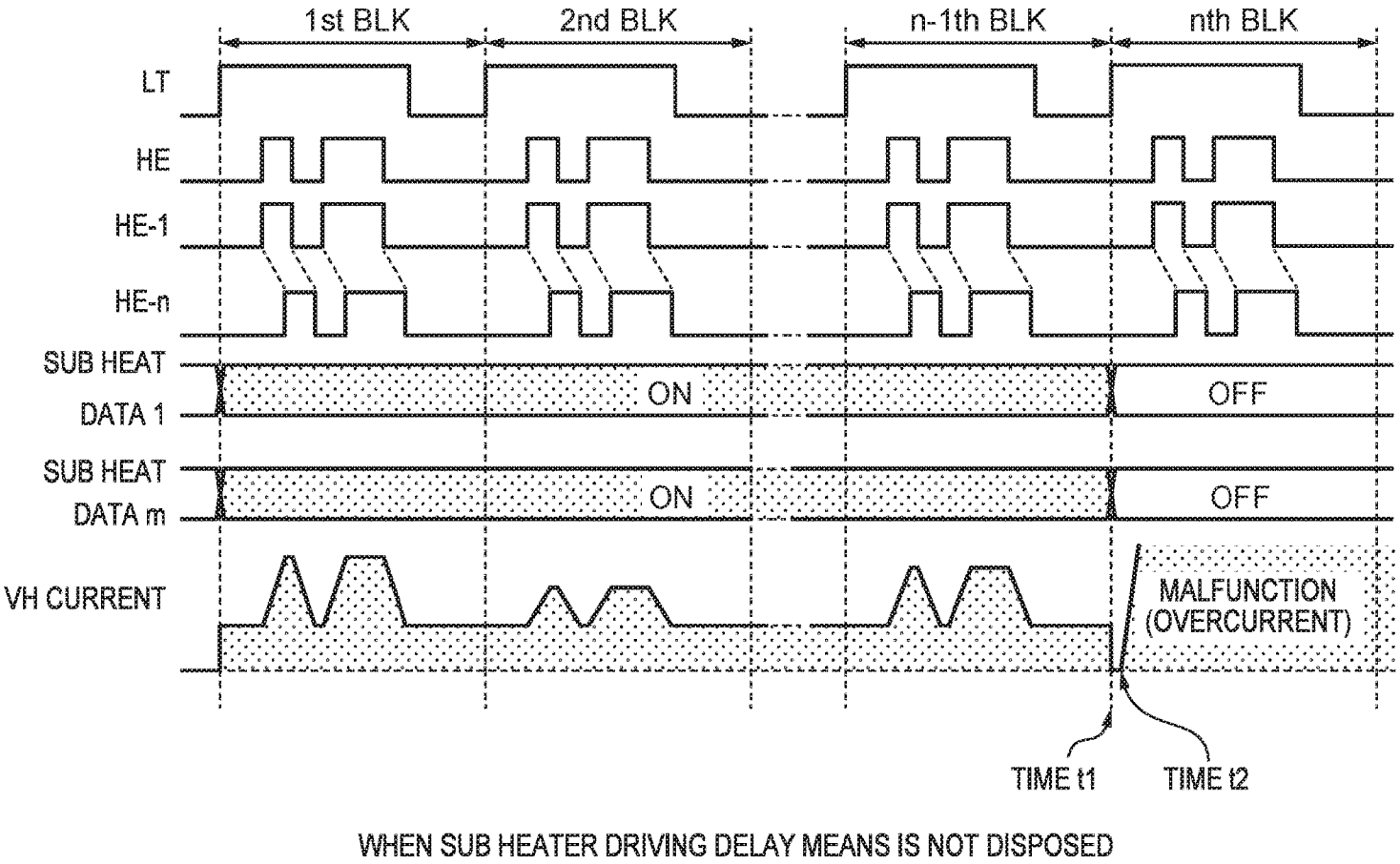
FIGS. 7A and 7B are views illustrating timing charts of the printhead according to a first embodiment.
Figure 7B:
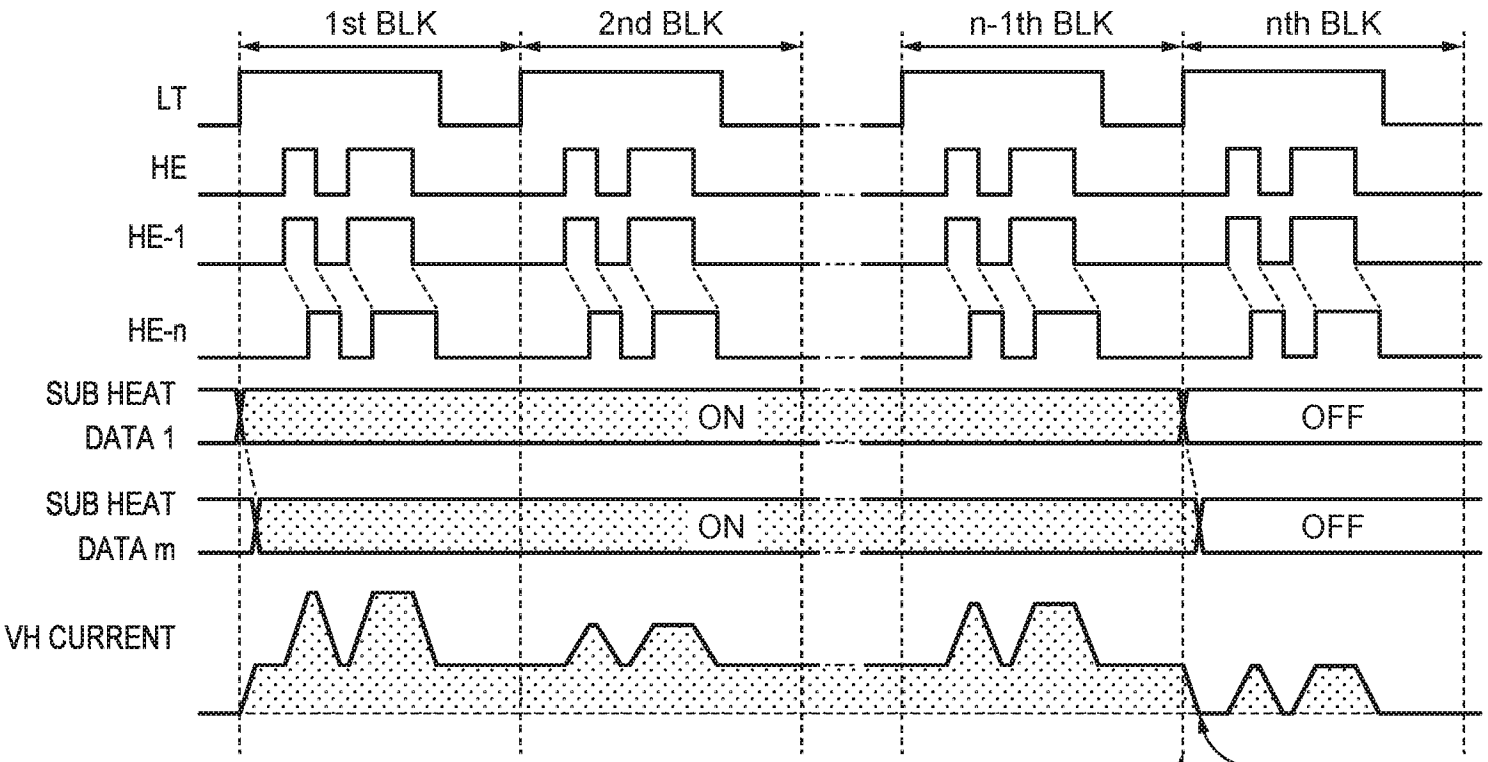

FIG. 7A indicates a timing chart of a case in which the printhead does not comprise a sub-heater driving delay means (the latch signal delay circuit 208) according to the present application invention. Meanwhile, FIG. 7B illustrates a timing chart for the printhead 100 in the present embodiment.

In order to heat a very small amount of ink (for example, one picoliter) in one nozzle to cause it to be discharged, the driving time of the printing element 102 may be relatively short, several hundred n(nano) seconds. Therefore, the printing element 102 is driven by the high frequency heat-enable signal (HE). Meanwhile, because it is necessary for the sub-heater 115 to heat a specific area of the element substrate whose heat capacity is large and to maintain the heat, it is necessary to lengthen the driving time by several tens of μ (micro) seconds to several hundred m (milli) seconds. For that reason, it is necessary that the sub-heater 115 be driven by a signal of a relatively low frequency. In the present embodiment, driving of the sub-heater 115 is performed with sub-heat data stored using a latch signal which is of a lower frequency than the heat-enable signal (HE). Furthermore, configuration is such that the timing at which the sub-heat data 1 to m are stored is delayed little-by-little by the latch signal delay circuit 208 which delays the latch signal in the printing element substrate 101 of the present embodiment. By this configuration, a sharp rising edge or falling edge occurring in the VH current when the sub-heater 115 is driven is prevented, and a malfunction occurring in the driving element 103 is prevented.

There is the merit that the transition timing of the current of the sub-heater 115 and the current of the printing element 102 never overlap in the configuration of the present embodiment. The printing element 102 must be driven using the heat-enable signal (HE) after the print data is reliably stored in the latch circuit using the latch signal (LT). For this reason, a timing margin (shift) of several hundred n (nano) seconds or more is arranged for the rising edge of the latch signal (LT) and the rising edge of the heat-enable signal (HE). Therefore, the transition timing of the current of the sub-heater 115 driven by the latch signal (LT) and the current of the printing element 102 driven by the heat-enable signal (HE) never overlap. In the printing element 102, a large current of a maximum of approximately 4 A (amperes) flows. Also, in the sub-heater 115, a large current of a maximum of approximately 1.5 A (amperes) flows. For this reason, it is important that the transition timings in the case of simultaneous driving reliably do not overlap.

Conventionally, the sub-heaters operate to be concurrently driven if the temperature of the printing element substrate is lower than a target temperature, and driving stops all at once if the temperature is higher than the target temperature. For this reason, the possibility that the sub-heat data will be rewritten all together at the same time is high, and there is a tendency for the peak value of a rewrite current to become higher. For this reason, a current momentarily flows at the rising edge of the latch signal (LT) which is the timing at which the sub-heat data is rewritten, and a momentary voltage drop occurs for the power supply of the logic circuit in the printing element substrate. If the voltage drop is large, it becomes the cause of a malfunction of the logic circuit.

In the configuration of the present embodiment, there is the merit that it is possible to suppress a peak value of a rewrite current that flows when data of the latch circuit 209 is rewritten. In the present embodiment, it is possible to suppress the peak value of the rewrite current because the configuration is such that the timing at which the sub-heat data is rewritten is reliably shifted by the latch signal delay circuit 208. That is, the timing at which the sub-heat data is rewritten is distributed by being shifted for each sub-heater 115. The result of this is that it is possible to make a voltage drop of a logic power supply be a minimum. By this, it is possible to provide a high reliability printing element substrate in which a logic circuit malfunction does not occur. That is, as illustrated in FIG. 7B, it is possible to prevent an overcurrent illustrated in FIG. 7A from flowing by the latch signal delay circuit 208 being disposed. In conjunction with this, it becomes possible to prevent a malfunction of the logic circuit.

Figure 8:
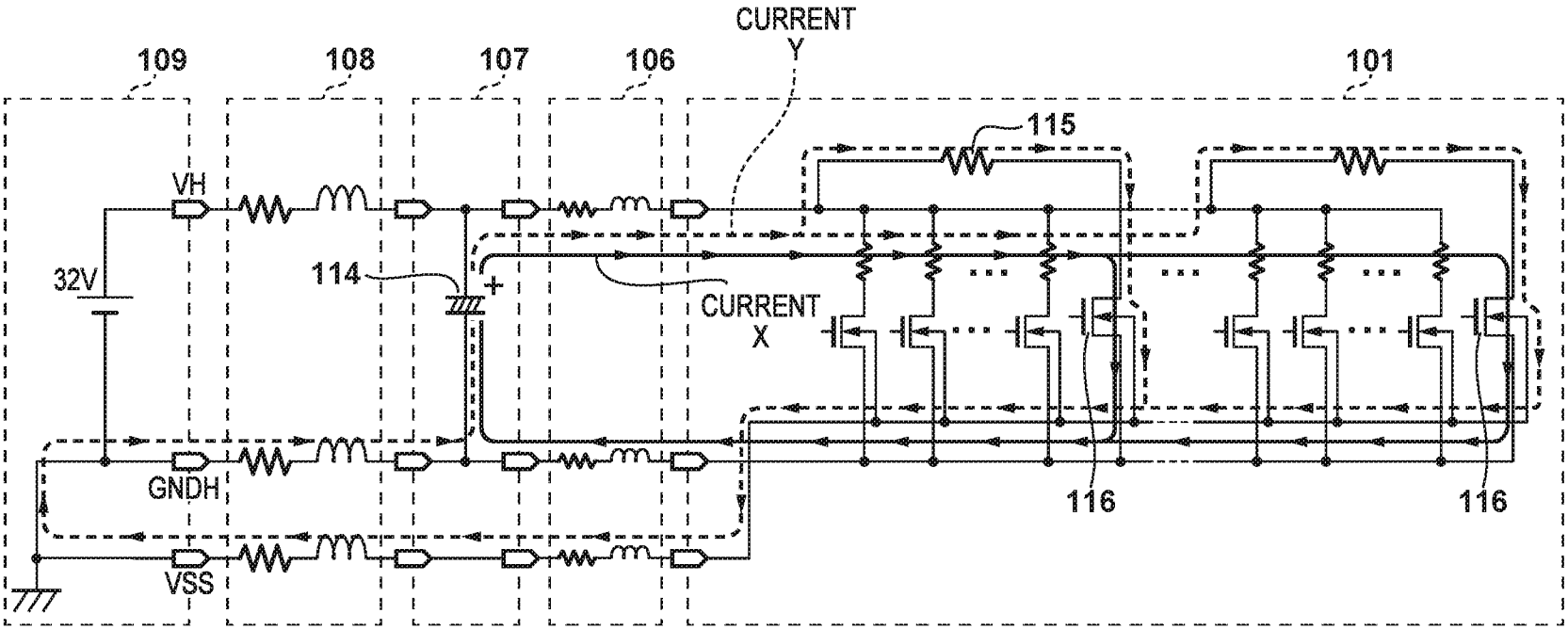
FIG. 8 is a view illustrating an equivalent circuit of the printhead according to a first embodiment.
Figure 9B:
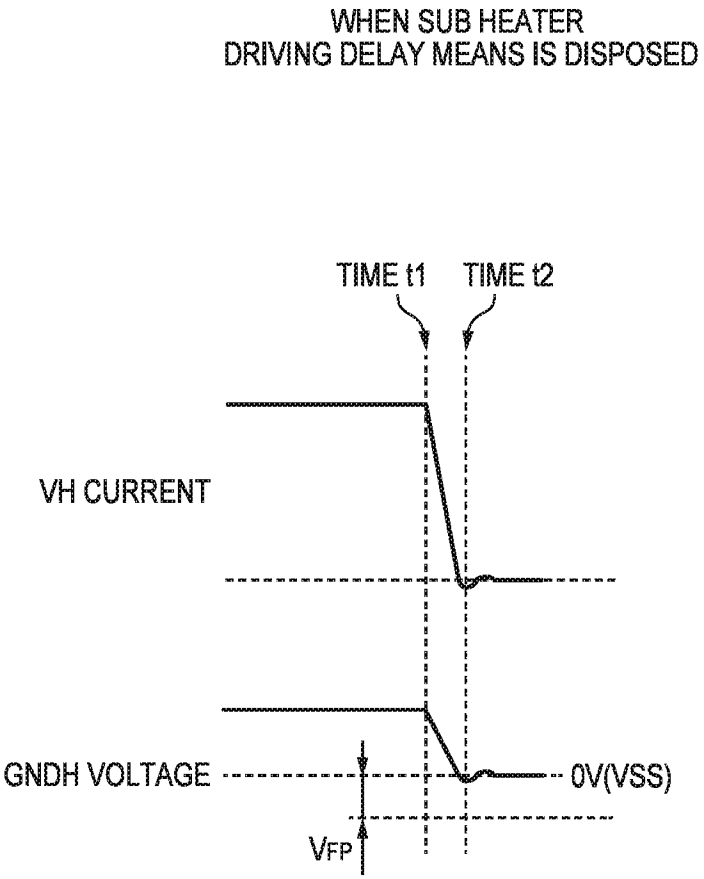
FIGS. 9A and 9B are views for describing operation waveforms of the printhead according to a first embodiment.
Figure 9A:
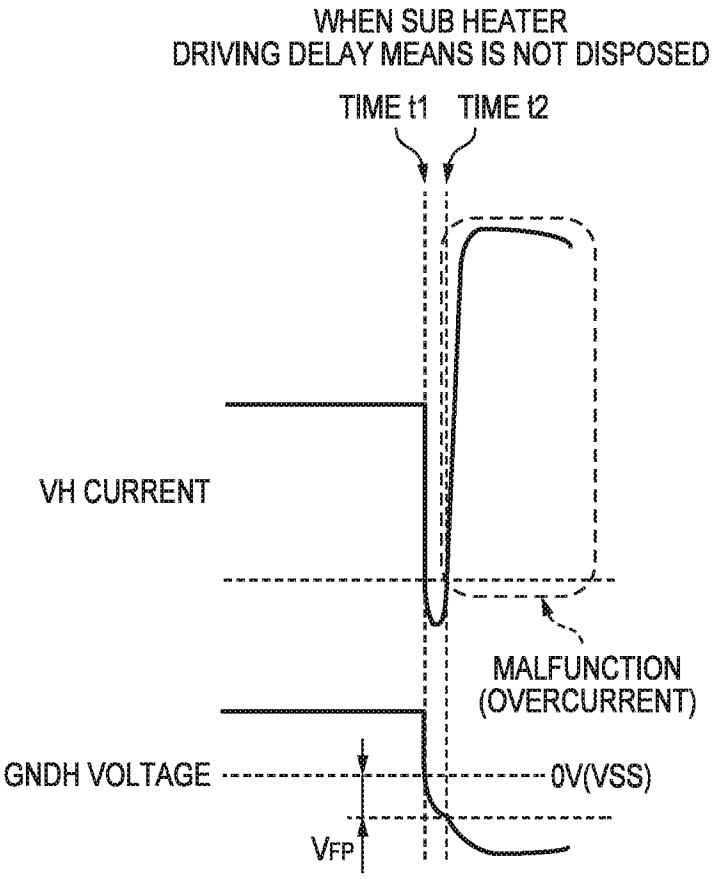

More detailed description is given. FIG. 8 is a view illustrating an equivalent circuit of the printhead 100 according to a first embodiment. Also, FIG. 9A and FIG. 9B are views illustrating an operation waveform of the printhead. FIG. 9A expands a portion of FIG. 7A, and FIG. 9B expands a portion of FIG. 7B. Using FIG. 8, FIG. 9A, and FIG. 9B, the effect of the latch signal delay circuit 208 is described. The arrow symbols illustrated in FIG. 8 indicate a path of the VH current of the printing element substrate 101 at time t1 (refer to FIG. 6) which is when sub-heat driving stops.

At time t1, two current paths—the current X illustrated by a solid line and the current Y illustrated by broken lines—occur (refer to FIG. 8). The current X is a current that flows between VH and GNDH, and is a normal current path for when driving the sub-heater 115. The current Y is a current that flows between VH and VSS, and is a leakage current that occurs when the FET which is the driving element transitions from an on state to an off state. Specifically, the current Y is a leakage current that occurs due to a positive charge being trapped in a depletion layer of the FET.

Figure 10:
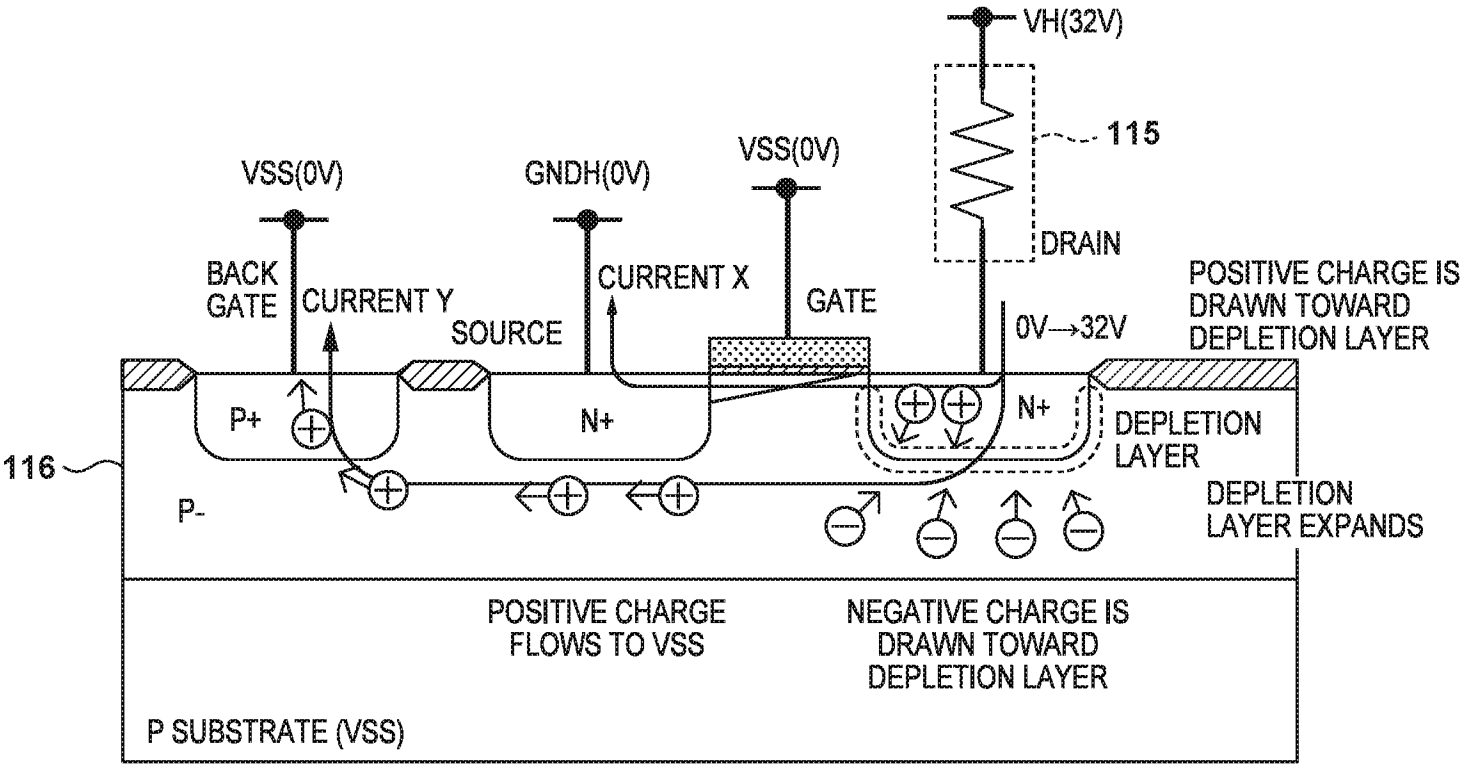
FIG. 10 is a cross-sectional view for describing operation of a driving element.

FIG. 10 is a view illustrating a cross section of the driving element (FET) at time t1. At time t1, the driving element transitions from the on state to the off state, and therefore the drain terminal gradually increases from 0V to the voltage of VH (32V). The depletion layer of a PN junction portion of the driving element expands by this, and a positive charge of an N diffusion layer on the drain side of the driving element is drawn towards the depletion layer, and a positive charge of a P diffusion layer on the source side flows out towards the 0V (VSS). By this, the current Y momentarily flows between VH and VSS.

As illustrated in FIG. 8, the current Y that flows between VH and VSS is supplied from the capacitor 114 between VH and GNDH momentarily, and therefore it ultimately flows towards GNDH. Accordingly, it flows into the head control substrate 109 in which VSS and GNDH are short-circuited. Because the current Y passes through the cable 108 which has large parasitic inductance at that time, larger ringing occurs the greater the frequency component included in the current Y is. FIG. 9A illustrates a waveform of a GNDH voltage in a case where the latch signal delay circuit 208 is not disposed. Because the current sharply falls when driving of the sub-heater 115 stops, the current Y includes a high frequency component. Thereby, large ringing occurs on the negative side in GNDH. Time t2 of FIG. 9A illustrates this state.

A negative potential difference occurs momentarily in VSS which is the substrate potential of the driving element (FET) and GNDH due to this ringing. When this exceeds the forward voltage VFP of the parasitic transistor of the driving element (FET) (GNDH voltage <–VFP), a parasitic NPN transistor of the driving element (FET) turns on and a large current occurs, and thereby a malfunction occurs in the driving element.

Figure 11A:
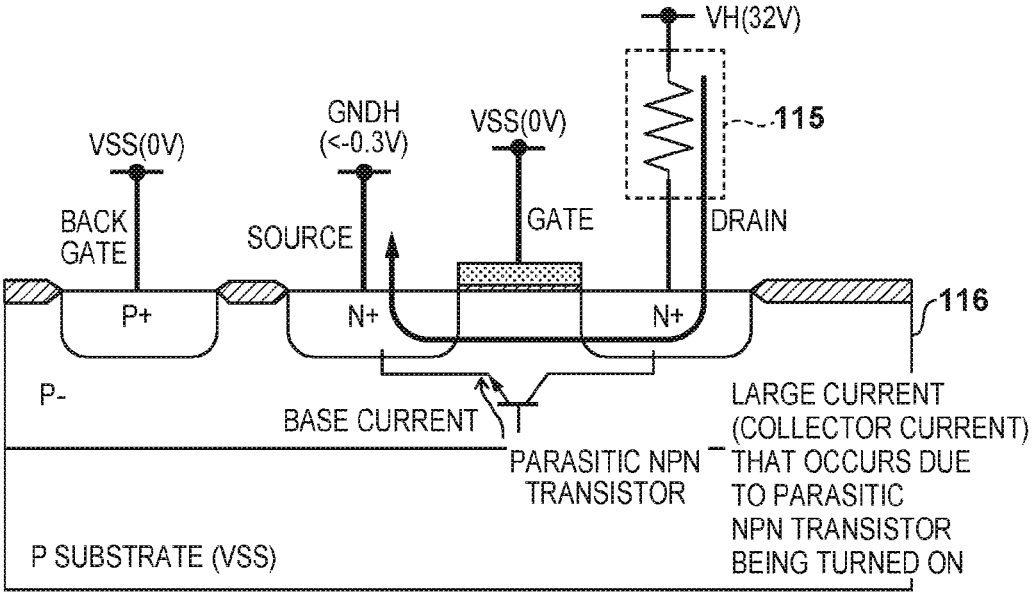
FIGS. 11A and 11B are cross-sectional views for describing the driving element in a malfunction state.
Figure 11B:
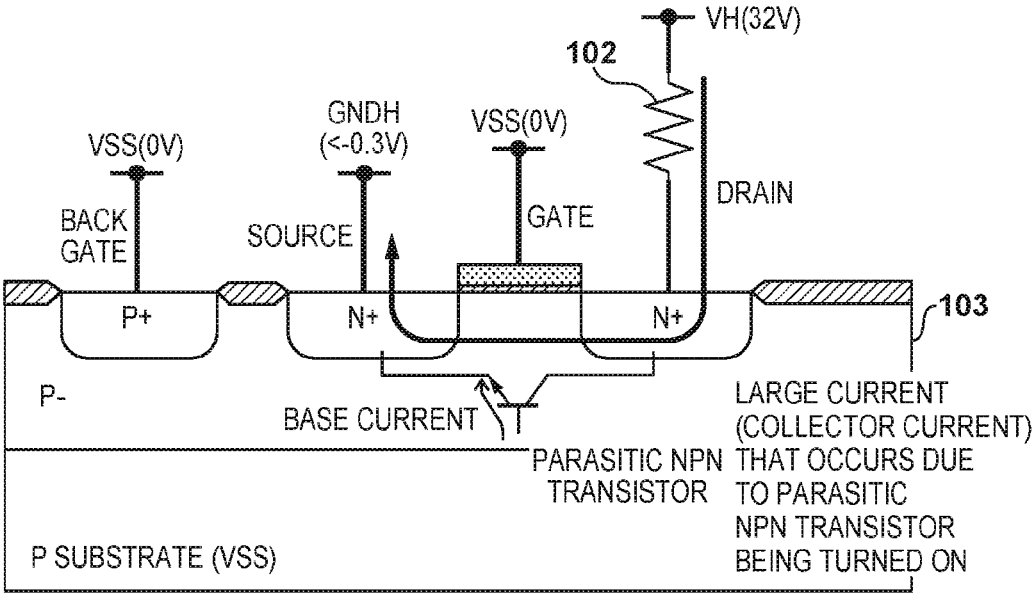

FIG. 11A and FIG. 11B are views illustrating a state in which the parasitic NPN transistor of the driving element (FET) enters an "on" state, and a malfunction occurs. FIG. 11A illustrates a sub-heater driving element and FIG. 11B illustrates a printing element driving element. Here, the sub-heater driving element and the printing element driving element are the same structure, and since GNDH is common, a malfunction occurs for both when the parasitic NPN transistor enters an "on" state.

Figure 12:
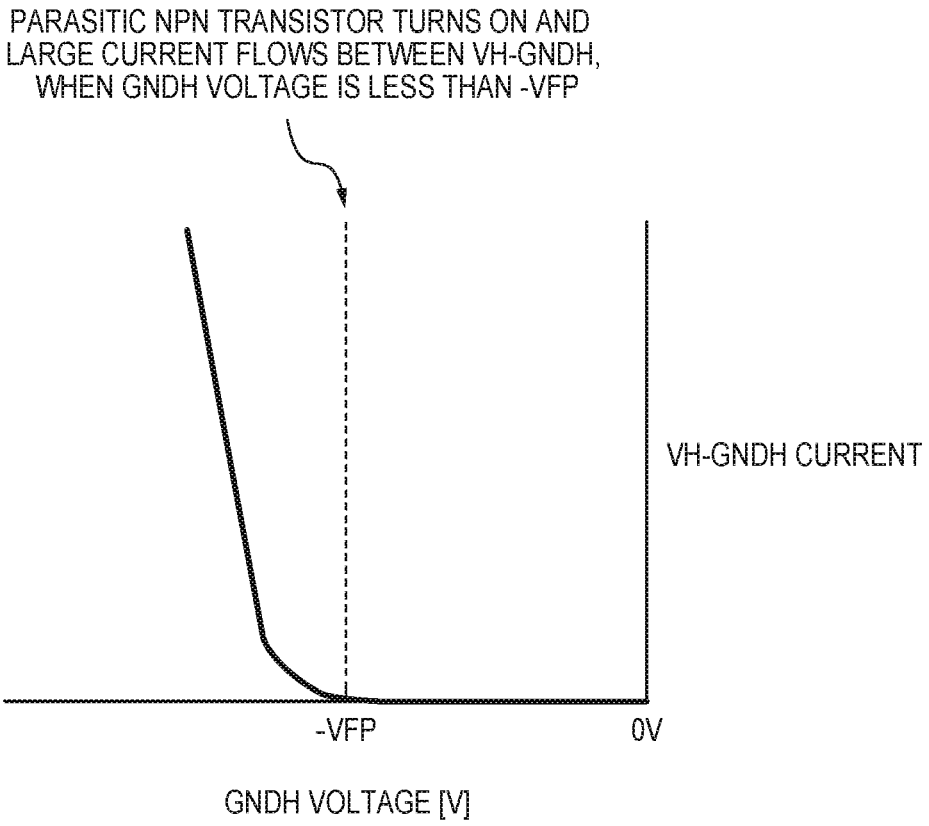
FIG. 12 is a view for describing current characteristics of a parasitic NPN transistor of the driving element.

FIG. 12 is a view illustrating current characteristics of a parasitic NPN transistor. When the GNDH voltage exceeds the forward voltage VFP (GNDH voltage <–VFP), the current increases exponentially. A large current flows in a path from VH to the printing element to the drain terminal of the FET to the source terminal of the FET to GNDH and a path from VH to the sub-heater to the drain terminal of the FET to the source terminal of the FET to GNDH. Accordingly, the current flows to the printing element 102, causing erroneous printing operation and printing element damage. Also, the current flows to the sub-heater 115, causing an abnormal temperature rise of the element substrate.

FIG. 9B illustrates a waveform of a GNDH voltage in a case where the latch signal delay circuit 208 according to the present embodiment is provided. Because it is possible to suppress a sharp fall of current when driving of the sub-heater 115 stops by the latch signal delay circuit 208, the current Y does not include a high frequency component. The result of this is that it is possible to suppress large ringing to the negative side of GNDH according to the current Y. By this, a potential difference between GNDH and VSS ceases to exceed the forward voltage VFP of the parasitic transistor of the driving element (FET), and the driving element (FET) ceases to cause a malfunction. Time t2 of FIG. 9B illustrates this state. In time t2 of FIG. 9B, the GNDH voltage is near the substrate potential (VSS).

By the present embodiment, the printhead can achieve both prevention of malfunctioning of the logic circuit at a time of sub-heater driving and prevention of malfunctioning of the driving element, and it becomes possible to realize higher reliability.

<Second Embodiment>

Figure 13:
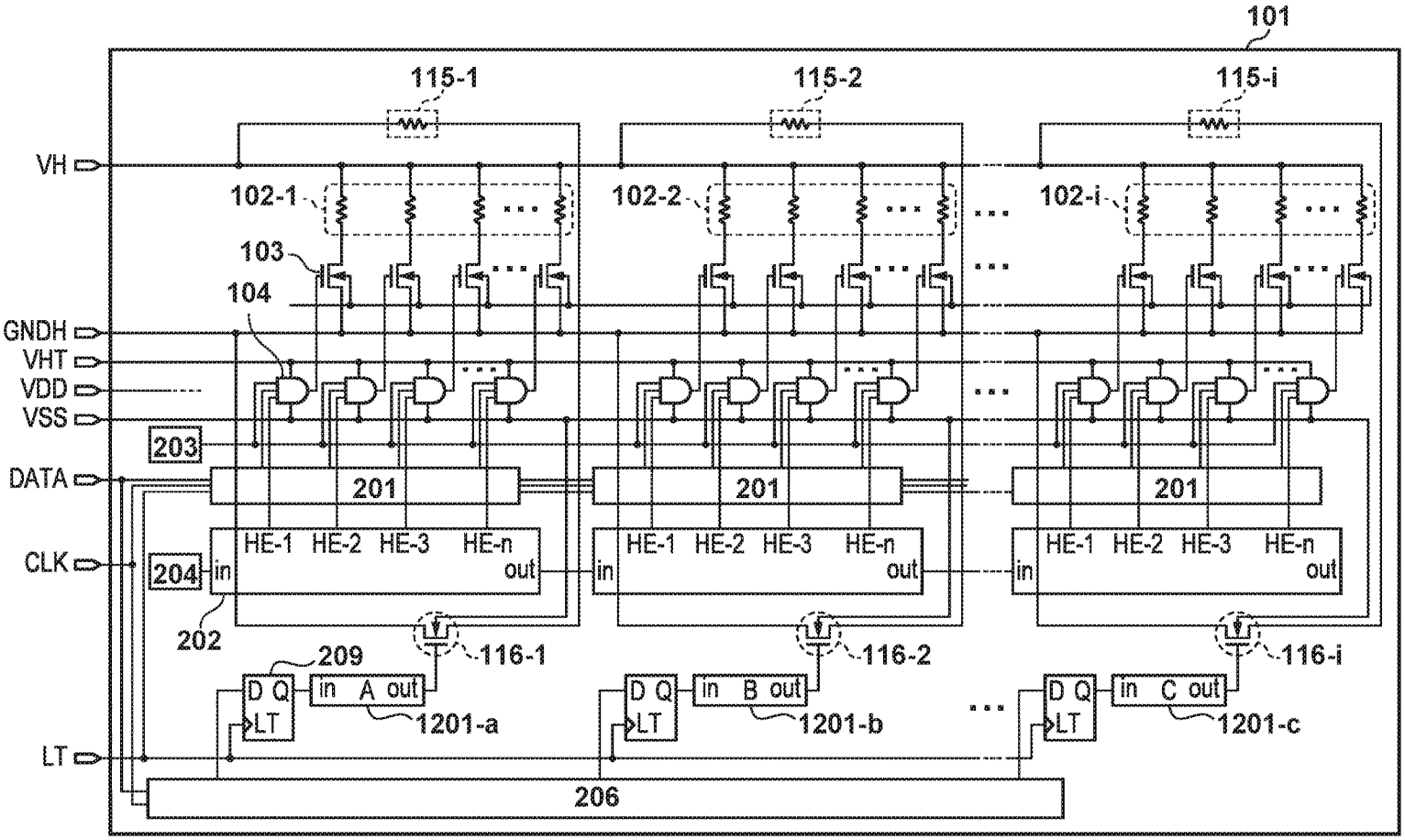
FIG. 13 is a view illustrating an example of a configuration of the printing element substrate according to a second embodiment.

FIG. 13 is a view illustrating an example of a detailed configuration of the printing element substrate 101 according to a second embodiment of the present invention. It is different to the first embodiment in that a plurality of sub-heat data signal delay circuits 1201-*a*, 1201-*b*, and 1201-*c* whose delay times differ are disposed. Note that the number of sub-heat data signal delay circuits 1201 illustrated in FIG. 13 is only an example, and can be configured in accordance with the configuration of the printing element substrate. Other configurations are similar to the first embodiment and so description thereof is omitted.

In the present embodiment, the sub-heat data signal delay circuit 1201 receives a signal outputted from the latch circuit 209 as input, and outputs it as a delayed data signal that is delayed by a predetermined delay time.

Figure 14:
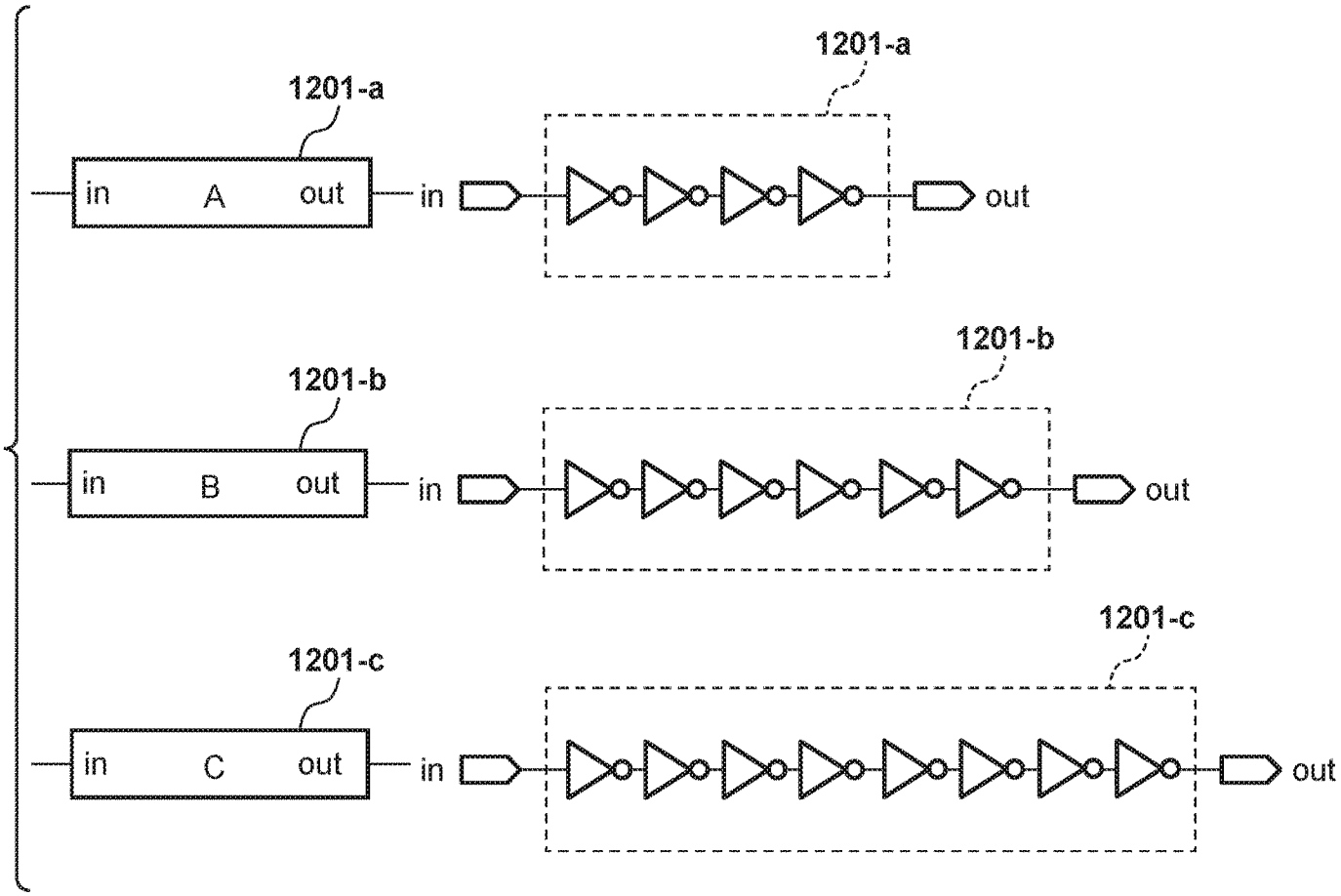
FIG. 14 is a view illustrating configuration examples of a sub-heat data delay circuits.

FIG. 14 illustrates an example of the sub-heat data signal delay circuits 1201-*a*, 1201-*b*, and 1201-*c*. A plurality of inverter circuits are configured in the example of FIG. 14, and by changing the number of steps of the inverter circuits, the delay times corresponding to the respective a sub-heat data signal delay circuits are made to be different.

By the present embodiment, similarly to the first embodiment, occurrence of a sharp rising edge or falling edge of the sub-heat current can be prevented, and a malfunction in the driving element can be prevented.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-110214, filed Jun. 1, 2016, which is hereby incorporated by reference herein in its entirety.

What is claimed is:

1. An element substrate comprising:

a plurality of printing elements configured to discharge liquid;

a plurality of first driving elements disposed in correspondence with the plurality of printing elements and configured to drive the plurality of printing elements;

a plurality of heating elements configured to heat the element substrate, the heating elements not causing liquid discharge from the printing elements;

a plurality of second driving elements disposed in correspondence with the plurality of heating elements and configured to drive the plurality of heating elements;

a plurality of latch circuits disposed in correspondence with the plurality of second driving elements, and configured to output heat data signals to the plurality of second driving elements based on latch signals; and a delay unit configured to delay timing of driving the plurality of second driving elements to drive the plurality of second driving elements at a predetermined time difference when driving the plurality of second driving elements simultaneously, wherein the delay unit comprises a plurality of delay circuits disposed in correspondence with the plurality of latch circuits and configured to delay either the latch signals or the heat data signals.

2. The element substrate according to claim 1, wherein at least one of timings at which driving of the plurality of second driving elements start and timings at which driving of the plurality of second driving elements stop are caused to be different by the delay of the driving timing by the delay unit.

3. The element substrate according to claim 1, further comprising a first power supply line configured to supply power to the printing elements; and a first ground line, wherein a first serial circuit in which the printing elements and the first driving elements are serially connected and a second serial circuit in which the heating elements and the second driving elements are serially connected are electrically connected between the first power supply line and the first ground line.

4. The element substrate according to claim 3, further comprising a logic circuit configured to control driving of the printing elements; and a second ground line, wherein a ground terminal of the logic circuit is electrically connected to the second ground line.

5. The element substrate according to claim 4, wherein the first driving elements include a transistor, and a back gate of the transistor is electrically connected to the second ground line.

6. A printhead comprising:

a plurality of printing elements configured to discharge liquid;

a plurality of first driving elements disposed in correspondence with the plurality of printing elements and configured to drive the plurality of printing elements;

a plurality of heating elements configured to heat an element substrate, the heating elements not causing liquid discharge from the printing elements;

a plurality of second driving elements disposed in correspondence with the plurality of heating elements and configured to drive the plurality of heating elements;

a plurality of latch circuits disposed in correspondence with the plurality of second driving elements, and configured to output heat data signals to the plurality of second driving elements based on latch signals; and a delay unit configured to delay timing of driving the plurality of second driving elements to drive the plurality of second driving elements at a predetermined time difference when driving the plurality of second driving elements simultaneously, wherein the delay unit comprises a plurality of delay circuits disposed in correspondence with the plurality of latch circuits and configured to delay either the latch signals or the heat data signals.

7. The printhead according to claim 6, wherein at least one of timings at which driving of the plurality of second driving elements start and timings at which driving of the plurality of second driving elements stop are caused to be different by the delay of the driving timing by the delay unit.

8. A printing apparatus comprising:

a plurality of printing elements configured to discharge liquid;

a plurality of first driving elements disposed in correspondence with the plurality of printing elements and configured to drive the plurality of printing elements;

a plurality of heating elements configured to heat an element substrate, the heating elements not causing liquid discharge from the printing elements;

a plurality of second driving elements disposed in correspondence with the plurality of heating elements and configured to drive the plurality of heating elements;

a plurality of latch circuits disposed in correspondence with the plurality of second driving elements, and configured to output heat data signals to the plurality of second driving elements based on latch signals; and a delay unit configured to delay timing of driving the plurality of second driving elements to drive the plurality of second driving elements at a predetermined time difference when driving the plurality of second driving elements simultaneously, wherein the delay unit comprises a plurality of delay circuits disposed in correspondence with the plurality of latch circuits and configured to delay either the latch signals or the heat data signals.

9. The printing apparatus according to claim 8, wherein the printing apparatus comprises a printhead and a power supply substrate, the printhead comprising:

a logic circuit configured to control driving of the printing elements;

a first ground line for the printing element; and a second ground line for the logic circuit, and the power supply substrate comprising:

a power circuit configured to generate power to be supplied to the printhead, wherein in the power supply substrate, the first ground line and the second ground line are electrically connected to a common ground.

10. The printing apparatus according to claim 8, wherein the printing apparatus comprises:

a first power supply line configured to supply power to the printing elements from the power circuit; and a first ground line, wherein a first serial circuit in which the printing elements and the first driving elements are serially connected and a second serial circuit in which the heating elements and the second driving elements are serially connected are electrically connected between the power supply line and the first ground line.

* * * * *